United States Patent [19]

van Straaten et al.

[11] Patent Number: 4,993,518

[45] Date of Patent: Feb. 19, 1991

[54] METHOD AND APPARATUS FOR THE GROUP CONTROL OF ELEVATORS WITH DOUBLE CARS

[75] Inventors: Johannes van Straaten, Kriens; Miroslav Kostka, Ballwil, both of Switzerland

[73] Assignee: Inventio AG, Switzerland

[21] Appl. No.: 427,743

[22] Filed: Oct. 26, 1989

[30] Foreign Application Priority Data

Oct. 28, 1988 [CH] Switzerland ..... 04032/88

[51] Int. Cl.[5] ..... B66B 1/18

[52] U.S. Cl. ..... 187/127

[58] Field of Search ..... 187/121, 124, 125, 127, 187/130

[56] References Cited

U.S. PATENT DOCUMENTS

| | | | |
|---|---|---|---|
| 4,210,227 | 7/1980 | Zeindler et al. | 187/127 |
| 4,263,989 | 4/1981 | Zeindler et al. | 187/127 |
| 4,337,847 | 7/1982 | Schröder et al. | 187/101 |
| 4,355,705 | 10/1982 | Schröder et al. | 187/127 |
| 4,582,173 | 4/1986 | Schroder | 187/127 |
| 4,632,224 | 12/1986 | Nowak et al. | 187/127 |
| 4,655,325 | 4/1987 | Schroder | 187/127 |
| 4,718,520 | 1/1988 | Schroder | 187/127 |

FOREIGN PATENT DOCUMENTS

| | | |
|---|---|---|
| 0026406 | 4/1981 | European Pat. Off. . |
| 0032213 | 7/1981 | European Pat. Off. . |
| 0050304 | 4/1982 | European Pat. Off. . |
| 0050305 | 4/1982 | European Pat. Off. . |
| 0062141 | 10/1982 | European Pat. Off. . |
| 0134892 | 3/1985 | European Pat. Off. . |
| 0177741 | 4/1986 | European Pat. Off. . |
| 0660585 | 5/1987 | Switzerland . |

*Primary Examiner*—A. D. Pellinen
*Assistant Examiner*—W. E. Duncanson, Jr.
*Attorney, Agent, or Firm*—Marshall & Melhorn

[57] ABSTRACT

In a group of elevators with double cars, the assignment of such double cars to floor calls takes place at scanner positions $\alpha$ in two procedural steps, according to two parameters: primarily by assignment of the individual cars of all double cars by logical decision, according to a criteria chain (KK), and subsidiarily by assignment of the double cars according to the minimal loss time of all involved passengers. The individual elevators each have a microcomputer system with a calculating device and are connected with each other by way of a comparator circuit to form a group control. The optimal individual cars are assigned for each elevator by floor in the associated individual car/call assignment memories. The optimal double car is selected by comparison of the loss times of all elevators calculated as the total operating costs $K_g(\alpha)$ and is assigned to the respective floor in the associated double car/call assignment memory. For the total servicing costs $K_g(\alpha)$, a special cost calculating algorithm is provided. With the separate assignment of individual cars and double cars, this group control renders possible a complete utilization of the double car functions as well as a good matching to different operating and traffic conditions. At the same time, the minimal waiting time of the passengers is optimized.

12 Claims, 2 Drawing Sheets

METHOD AND APPARATUS FOR THE GROUP CONTROL OF ELEVATORS WITH DOUBLE CARS

BACKGROUND OF THE INVENTION

The present invention relates generally to a method and an apparatus for the group control of elevators with double cars and, in particular, to a method and an apparatus for determining the elevator optimally available for assignment for serving a floor call.

In a group control for elevators with single cars, disclosed in the European Pat. No. 0 032 213, assignments of the floor calls to the cars are optimized by the time to serve which is dependent on the distance from the call. In this patent, a sum of the time losses proportional to the waiting passengers and the time losses of the passengers in the car is calculated from the distance between the floor and the car position indicated by the floor selector, the intermediate stops to be expected within this distance and the instantaneous car load. The calculation is performed by means of computing equipment, such as a microprocessor, during a scanning cycle of a first scanner at every floor, whether a floor call is present or not. The car load existing at the instant of calculation is corrected in such a manner that the anticipated leaving passengers and entering passengers, derived from numbers of passengers leaving and entering in the past, are taken into consideration at the future intermediate stops. This sum of losses, also called operating costs, is stored in a cost memory. During a cost comparison cycle aided by a second scanner, the operating costs of all the elevator cars are compared with each other in a comparator circuit. For each comparison, an assignment command can be stored in an assignment register of the elevator car with the lowest operating costs, which assignment command designates that floor to which the respective car is assigned optimally in time.

The Swiss Pat. No. 660,585 discloses a control for an elevator group with double cars in which the group control described above has been improved in such a manner that the assignment of the individual cars of double car elevators to the floor calls can be optimized by time. The operating costs are calculated for each of the two individual cars of a double car elevator and are compared with each other by means of a comparator circuit, wherein the lower operating costs are stored in the cost memory of the respective elevator. In response to the presence of assignment commands for equidirectional floor calls of two neighboring floors and/or coincidences of car calls and floor scanner positions, the operating costs to be stored are reduced. This control for the elevator group interprets the double car as two individual cars which compete with each other.

The sum of losses or operating costs, disclosed in the European Pat. No. 0 032 213, is solely dependent on the position and the direction of the calls, on the car load and on the operational status of the car, and is calculated, as in the Swiss Pat. No. 660,585, for each individual car of the double car. In such a calculation, the mutual influences and relationships between the two individual cars are not fully taken into account. The lower operating costs of the individual cars of a double car are then stored in the cost memory of the corresponding elevator and compared for each floor with the lower operating costs of the other double cars in the elevator group. In controls of this type, the floor calls are not assigned to the optimal double car, but to the optimal single car. A uniform distribution of the passengers in the double cars in the elevator group is therefore impaired during normal operation of the elevator installation. By the separate calculation of the operating costs of the two individual cars, only coincidences of car calls of the respective car and floor scanner position can be promoted by a reduction of the operating costs of the respective car. The stopping at neighboring floors, where the other individual car not participating in a car call is concerned, is not promoted. An optimal assignment of the floor calls to the double cars is therefore not possible in all cases. From the above, it can be inferred that a group control for elevators with double cars, which considers the two cars of a double car as a single car, cannot achieve optimum results with respect to a minimum number of stops, short average waiting times of the passengers and an increased transport capacity.

SUMMARY OF THE INVENTION

The present invention concerns the problem of creating a method and an apparatus, based on the elevator group control disclosed in the Swiss Pat. No. 660,585, to utilize fully for serving calls, in group controls for elevators with double cars, the two degrees of freedom provided by the individual cars of each double car and the double cars of each group. The availability of a double car with respect to a floor call shall be determined not only by the position and direction of this floor call, as well as the loading and operating conditions of the two individual cars, but also by the different variants of the call serving which result from the possibility of the simultaneous serving of two neighboring calls by the two individual cars. Therefore, in the calculation of the operating costs of a double car, the mutual cost influences of the two individual cars have to be considered. Furthermore, the method and apparatus have to be designed in such a way that they can be adapted easily and rapidly to different operating conditions and traffic situations and that the expense of the required calculating is a minimum.

This invention proposes for the solution of this problem, with the consideration of the mutual influence of the partial operating costs calculated separately for each individual car, to recursively calculate total operating costs for every double car in the elevator group for all floor scanner positions. At the existence of assignment commands for equidirectional floor calls of two neighboring floors (congruence) and/or the coincidences of car calls and floor scanner positions, the total operating costs are reduced. The total operating costs of all elevators are compared with each other by a comparator circuit. In each case, an assignment command can be stored in an assignment memory of the elevator with the lowest total operating costs, which command designates that floor to which the respective double car has been assigned optimally in time. Through a selection based on chains of criteria of each double car, a specific individual car is assigned to the floor call in such a way that the serving of car calls and equidirectional floor calls at the same floor, equidirectional floor calls of two neighboring floors, and car calls and equidirectional floor calls of two neighboring floors are promoted. Also, the overlapping of "own" stopping positions, that is stops of an individual car at a floor where the other individual car of the double car had stopped shortly before or will stop shortly thereafter, is reduced to unavoidable exceptions and, that overlappings of "alien" stopping positions, that is stops of a double car at a floor where another double car of the same group stops at the same time, are avoided whenever possible.

The advantages realized by the invention are due to the fact that, in each case, the double car with the lowest total operating costs is assigned to a floor call. At a single floor call and with no existing coincidence and/or congruence, the less loaded car, or by choice also the car "in front" or "behind" in the direction of travel, is assigned to the floor call. The stopping at the same floor having the car call and an equidirectional floor call, and/or at two neighboring floors with equidirectional floor calls, or at two neighboring floors with car calls and equidirectional floor calls is promoted in such a way that less stops are generated, the individual double cars distribute the total traffic uniformly amongst each other, and the two individual cars of a double car are filled uniformly. Thereby, the waiting times at the floors and the travel times are reduced, the waiting times in the non-serving car are kept to the "absolutely necessary" minimum at eventual intermediate stops and the transport capacity is increased. Furthermore, this solution distinguishes itself by the fact that, due to the adjustable parameters, priorities can be achieved for the operating behavior of the elevators so that, for example, an equal load is strived for between the individual cars, or that the load equalization is only effective starting from the adjustable imbalance of the two individual cars.

The method and apparatus according to the present invention makes a determination of the elevator optimally available for assignment for serving a floor call at a floor E at a certain floor scanner position $\alpha$. The lost time, defined as all the operating costs of serving passengers involved in the call, is the criterion for the decision. The operating costs are calculated and are stored for each elevator car separately within the framework of a cost calculating cycle for each floor scanner position $\alpha$—regardless of whether or not a floor call is present—and are compared subsequently for all the elevator cars together within the cost comparison cycle. The elevator car with the lowest operating costs for the corresponding scanner position $\alpha$ is favored for serving a future floor call and a selected car of the corresponding double car is assigned to the scanner position to be served. It is possible with such group controls to assign the double cars to the floor calls in such a manner that the minimum average waiting times and the minimum average travel times to the destinations of the passengers are achieved. In elevator groups, this results in an increase in the transport capacity, an improved behavior of operation and, thus, a general alleviation of traffic problems.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
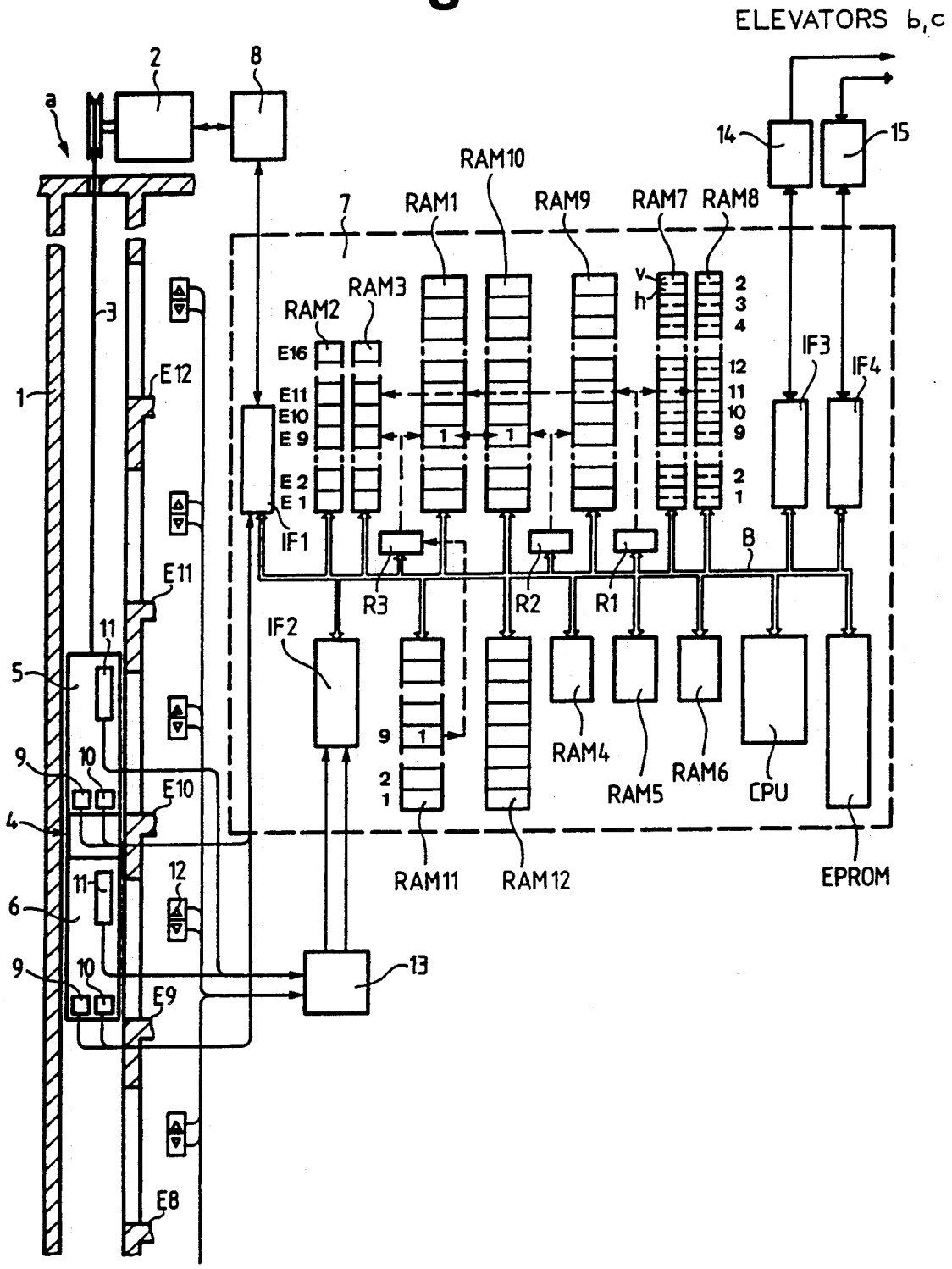
FIG. 1 is a schematic block diagram of a group control according to the present invention for an elevator group consisting of three elevators.

Designated with 1 in FIG. 1 is the elevator shaft of an elevator a of an elevator group including, for example, three elevators a, b and c. A hoist 2 drives, by way of a hoisting cable 3, a double car 4 formed by two individual cars 5 and 6 arranged in a common frame and guided in the elevator shaft 1, where, according to the elevator installation chosen as an example, sixteen floors El to E16 are served. The spacing of the two individual cars is chosen in such a way that it corresponds with the distance between two neighboring floors. The hoist 2 is controlled by a drive control disclosed in the European Pat. No. 0 026 406, wherein the nominal value, the control function and the stop initiation signals are generated by a microcomputer system 7, and whereby measurement and regulating units 8 of the drive control are connected with the microcomputer system by a first interface IF1. Each individual car 5 and 6 of the double car 4 includes a load weighing device 9, a device 10 for signalling the actual operating status Z of the car and car call buttons 11. The devices 9 and 10 are connected with the microcomputer system 7 by the first interface IF1. The car call buttons 11 and floor call buttons 12 provided at the floors are connected to the microcomputer system 7, for example, by an input device 13 and a second interface IF2 as disclosed in the European Pat. No. 0 062 141.

The microcomputer system 7 consists of a floor call memory RAM1, two car call memories RAM2 and RAM3 assigned respectively to the cars 5 and 6 of the double car 4, a load memory RAM4 storing the instantaneous load PM of each of the cars 5 and 6, two memories RAM5 and RAM6 storing the operating status Z of the cars 5 and 6, two tabular cost portion memories RAM7 and RAM8 assigned to the cars of the elevator, a first total cost memory RAM9, a second total cost memory RAM10, an individual car/call assignment memory RAM11, a double car/call assignment memory RAM12 indicating the elevator with the lowest operating costs per scanner position and serving direction, a program memory EPROM, a power failure-proof data memory DBRAM (not shown but similar to the memory EPROM), and a microprocessor CPU which is connected with the memories RAM1 through RAM12, the EPROM and the DBRAM by a bus B. A first and a second scanner of a scanning device are designated by R1 and R2 respectively, where the scanners R1 and R2 are registers by means of which addresses can be formed corresponding to the floor numbers and the direction of travel.

The cost memories RAM7 to RAM10 each have one or more storage locations which can be assigned to the possible individual car positions. Designated with R3 and R4 (not shown) are selectors in the form of a register corresponding to the individual cars, which register indicates for a traveling car the address of the floor at which that car can still stop. In FIG. 1, if R3 is associated with the upper car, R4 is associated with the lower car, also is connected to the bus B and would be indicating the floor E8. At standstill, R3 and R4 indicate the floor at which a call can be served or a possible car position at "blind" floors, floors without an entrance. As is known from the above cited drive control, travel distances are assigned to the selector addresses, which distances are to be compared with a travel distance generated in a nominal value signal generator. At equality of these distances and the existence of a stop command, the stopping phase of the car is initiated. If no stop command exists, the selectors R3 and R4 are switched to the next floor.

Figure 2:
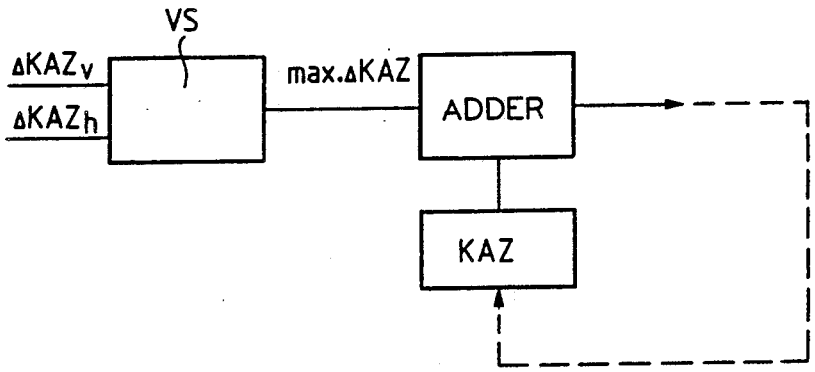
FIG. 2 is a schematic block diagram of a comparator circuit in the elevator group control shown in FIG. 1.

A comparator circuit VS, shown in FIG. 2, is connected with the partial cost memories RAM7 and RAM8, the total cost memories RAM9 and RAM10 and the individual car/call assignment memory RAM11. The microcomputer systems 7 of the individual elevators a, b and c are connected with each other by a comparator circuit 14 and a third interface IF3, as shown in the European Pat. No. 0 050 304, as well as by way of a partyline transmission system 15 and a fourth interface IF4 as shown in the European Pat. No. 0 050 305, and form the group control according to the invention.

Figure 3:
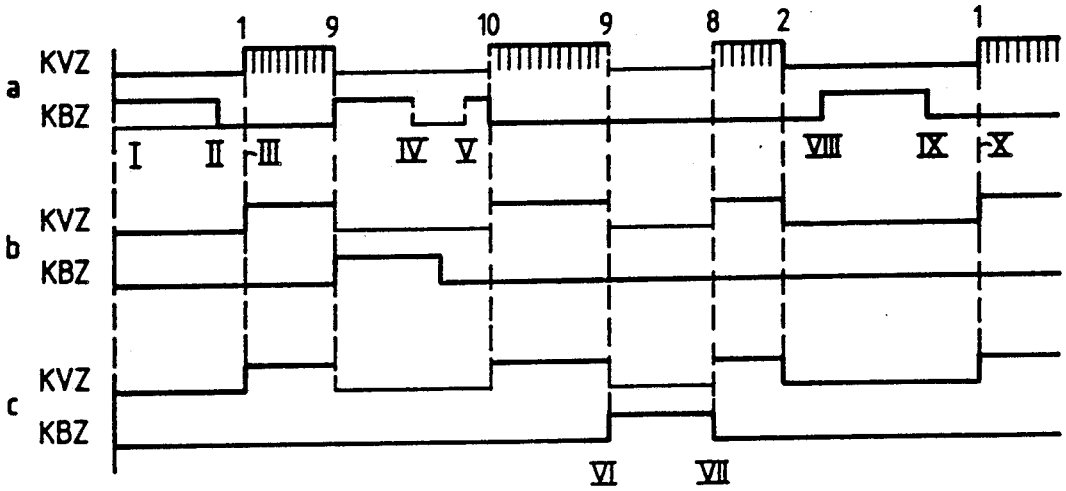
FIG. 3 is a diagram of magnitude versus time of the signals generated by the elevator group control shown in FIGS. 1 and 2.

The operation over time and the function of the above described group control will be explained as follows with the aid of FIG. 3. Upon the occurrence of an event concerning a certain elevator a, b or c of the group, such as, for example, the input of a car call, an assignment of a floor call, a change in the load or door conditions, or a change of the selector position, the first scanner R1 assigned to the respective elevator starts with a cycle called a cost calculating cycle KBZ. The cycle starts from the last selector position in the direction of travel of the car (in case of no direction of travel, starting at the lower car), although the cycle can also take place in another direction or sequence. Assume the event occurred with respect to the elevator a at a point in time I. At each scanner position, a sum proportional to the time losses of all involved passengers is calculated by the microprocessor CPU of the microcomputer system 7 for each of the cars 5 and 6 and for the double car 4 as set forth in the following description. The sum, also called the operating costs K, is calculated wherein the individual shares of the costs are determined by the group control for elevators with double cars operating according to the following principles.

The present invention defines a method for the group control of elevators with double cars in which, for the determination of an optimally applicable elevator (a, b and e) for the serving of a floor call at a floor (E) in a scanner position ($\alpha$), the operating costs defined as loss of time of all passengers involved in serving a call is the criterion of decision, and for which these operating costs are calculated and stored separately for each elevator within the framework of a cost calculating cycle KBZ for every scanner position ($\alpha$), whether a floor call exists or not. Subsequently, these costs are compared for all elevators together within the framework of a cost comparison cycle KVZ, wherein the elevator with the lowest operating costs for the respective scanner position ($\alpha$) is assigned by a control apparatus as the favored for-serving an eventual floor call and wherein also the assignment of a certain individual car 5 or 6 of the corresponding double car 4 is provided for the scanner position ($\alpha$) to be served. The method includes the following steps:

Step a—For the characterization of the apple of a double car 4 with respect to the serving of a floor call in a scanner position ($\alpha$), the following equation defines the total operating costs $K_g(\alpha)$ for the double car as:

$$K_g(\alpha)=G\cdot K_{Ig}(\alpha)+K_{Ag}(\alpha)$$

wherein the terms stand for:

$K_g(\alpha)$: the total operating costs of a double car for the scanner position $\alpha$ $K_{Ig}(\alpha)$: the internal total operating costs of a double car for the scanner position $\alpha$ $K_{Ag}(\alpha)$: the external total operating costs of a double car for the scanner position $\alpha$ G: a weighting factor;

Step b—For the serving of a scanner position ($\alpha$) by a double car 4, certain standard call serving positions are established by the position of the individual cars 5 and 6 depending on the call serving directions the serving $\alpha$, $\alpha+1$ for the downward call serving direction, as well as the serving position $\alpha,\alpha-1$ for the upward call serving direction and the standardized total operating costs $K_{gs}(\alpha)$ defined as follows:

$$K_{gs}(\alpha)=G\cdot[S\cdot[K_{Iv}(\alpha)\pm K_{Ih}(\alpha+1)]]+[K_{Av}(\alpha)+K_{Ah}\cdot(\alpha\pm1)]$$

wherein in the terms represent:

$K_{gs}(\alpha)$: the standardized total servicing costs of a double car for the scanner position $\alpha$ G: a weighting factor S: a status factor for coincidence of the scanner position and car call with S=0 at coincide and S=1 without coincidence $K_{Iv}(\alpha)$: the internal partial operating costs of the front individual car in the direction of travel for the scanner position $\alpha$ $K_{Ih}(\alpha\pm1)$: the internal Partial operating costs of the rear individual car in the direction of travel for the positions ($\alpha+1$) and ($\alpha-1$) respectively $K_{Av}(\alpha)$: the external partial operating costs of the front individual car in the direction of travel for the scanner position ($\alpha$)

$K_{Ah}(\alpha\pm1)$: the external partial operating costs of the rear individual car in the direction of travel for the positions ($\alpha+1$) and ($\alpha-1$) respectively $K_{Iv}(\alpha)+K_{Ih}(\alpha\pm1)+K_{Ih}(\alpha\pm1)=K_{Ig}(\alpha)$: internal total operating costs $K_{Av}(\alpha)+K_{Ah}(\alpha\pm1)=K_{Ag}(\alpha)$: external total operating costs;

Step c—For every double car 4, the standardized total operating costs $K_{gs}(\alpha)$ are calculated with the framework of its cost calculating cycle KBZ in every scanner position ($\alpha$) according to step b by means of a cost calculating algorithm (KBA) and subsequently stored in a first total cost memory RAM9, wherein the internal operating costs $K_{Iv}(\alpha)$ and $K_{Ih}(\alpha\pm1)$ as well as the external operating costs $K_{Av}(\alpha)$ and $K_{Ah}(\alpha\pm1)$ are calculated separately and are also stored separately in corresponding partial cost memories RAM7 and RAM8 respectively;

Step d—For every double car 4, the individual car 5 or 6 optimal for serving is determined within the framework of its cost calculating cycle (KBZ) and marked in an individual car/call assignment memory RAM11, wherein immediately after the cost calculating algorithm (KBA), that call serving position ($\alpha,\alpha+1$) or ($\alpha,\alpha-1$) is found by means of a car assignment algorithm which is an optimum in the sense of a hierarchically sequenced chain of criteria (KK) for the respective scanner position ($\alpha$);

Step e—The total servicing costs $K_g(\alpha)$, designated as modified total servicing costs $K_{gm}(\alpha)$, are determined for every double car 4 within the framework of its cost calculating cycle KBZ in every scanner position ($\alpha$) for the optimal serving positions $\alpha$, $\alpha+1/\alpha$, $\alpha-1$ according to step d and stored in a second total cost memory RAM10, wherein the standardized total operating costs $K_{gs}(\alpha)$ are modified immediately after the car assignment algorithm (DZA) by means of a cost modification algorithm (KMA), depending on whether the car assignment according to step d agrees with the standardized call serving position or not; and Step f—The modified total operating costs $K_{gm}(\alpha)$ of all elevators a, b and c are compared, within the framework of the cost comparison cycle (KVZ) including all elevators of the elevator group, in a comparator circuit 14 for every scanner position $\alpha$, and the double car 4 with the lowest modified total operating costs $K_{gm}(\alpha)$ marked as "favored" for the serving of an eventual floor call at the scanner position $\alpha$ and, if necessary, the car is immediately assigned.

The cost calculating algorithm (KBA), for the calculation of the standardized total operating costs $K_{gs}(\alpha)$, is based on the following formula:

$$K_{gs}(\alpha)=G\cdot S\cdot t_v'[[P_{Mv}+K_{1v}\cdot R_{Ev}-k_{2v}-k_{Cv}]+[P_{Mh}+k_{1h}\cdot R_{Eh}-k_{2n}\cdot R_{Ch}]]+[m\cdot t_m+KAE+KAZ]\cdot k_{1g}$$

where the terms represent $t_v$: the median lost time, referring to the internal positioning $\alpha$ $t_v'$: the medium lost time, referring to the external costs, which results at a stop at the scanner position $\alpha$ $P_{Mv}$;$P_{Mh}$: the instantaneous car load in the front and rear cars respectively at the time of the calculation $R_{Ev}$;$R_{Eh}$: the number of assigned floor calls between selector and scanner positions for the front and rear cars respectively $R_{Cv}$;$R_{Ch}$: the number of car calls between selector and scanner positions for the front and rear cars respectively $k_{1v}$;$k_{1h}$: the probable number of entering passengers as a function of the traffic conditions per floor call for the front and rear cars respectively $k_{2v}$;$k_{2h}$: a probable number of exiting passengers as a function of the traffic conditions per floor call for the front and rear cars respectively m: the number of floor distances between selector and scanner positions $t_m$: the median travel time per floor distance $m.t_m$: the median lost time referring to the external costs which results from travelling the floor distances between selector and scanner positions KAE: the median lost time referring to the external costs which results from the levelling in at a scanner position $\alpha$ KAZ: the median lost time referring to the external costs which results from the intermediate stops $[m\cdot t_m+KAE+KAZ]$: the total lost time referring to the external costs $k_{1g}=k_{1v}+k_{1h}$: the probable total number of entering passengers per floor call in the front and the rear cars determined as a function of the traffic conditions $[P_{Mv}+k_{1v}.R_{Ev}-k_{2v}\cdot R_{Cv}]$: the number of passengers who have to wait in the front car at a stop at the scanner position $\alpha$ $[P_{Mh}+k_{1h}\cdot R_{Eh}-k_{2h}\cdot R_{CH}]$: the number of passengers who have to wait in the rear car at a stop at the scanner position $\alpha$.

The total lost time, determining the total external costs ($K_{Ag}$), is equal to the lost time ($m\cdot t_m$) for travelling the floor distances between the selector and scanner positions, increased by a first addition (KAE) for the lost time at the levelling in at the scanner position $\alpha$ and a second addition (KAZ) for the lost time from one or more intermediate stops. The first addition (KAE) is determined from the operating conditions of the double car 4 from which the leveling in at the scanner position $\alpha$ has to be accomplished, where for the operating conditions "acceleration", "full-speed travel" and "brake action", KAE is calculated from the respective drive status factor $S_A$ according to the formula $$KAE=S_A\cdot t_v'$$

and, for the operating status "stop", from the greater of the door status factors $S_{Tv}$;$T_h$ for the front and the rear individual cars 5 and 6 respectively according to the formula $$KAE=max[S_{Tv}/S_{Th}]\cdot t_v'.$$

The second addition KAZ is recursively calculated, as shown in FIG. 2, from the lost time ($KAZ_{init}$) at an eventual intermediate stop at the selector position and from the time losses $\Delta KAZ_v$ and $\Delta KAZ_h$ at eventual intermediate stops between the selector and scanner positions according to the formula $$KAZ=KAZ_{init}+\Sigma\Delta KAZ$$

where $KAZ_{init}$ is determined from the drive and door status factors of the double car 4 and for $\Delta KAZ$, the greater of the time losses $t_v'+k_{1v}+k_{2v}$ and $t_v'+k_{1h}+k_{2h}$ calculated for the front and rear individual cars respectively is taken An adder circuit has one input connected to an output of the circuit VS and another input connected to an output of a source of median lost time for intermediate stops KAZ. An output of the adder is selectively connected to an input of the KAZ source.

The criteria chains forming the basis of the car assignment algorithm (DZA) are hierarchically sequenced, wherein the criteria of highest priority are compiled in a group "compulsory assignment" and the criteria of low priority in a group "free assignment". For the group "compulsory assignment", the corresponding car assignments are required and the following criteria are used in descending, priority:

coincidence "car call-floor call"

serving of a scanner position $\alpha$ with the individual car 5 or 6 at full load non-serving of a scanner position $\alpha$ with the individual car 5 or 6 in the non-serving operating mode.

In the absence of a "compulsory assignment", the following criteria of a "free assignment are applied:

simultaneous serving of two neighboring cars 5 and 6 with or without adjustable imbalance no overlapping of "individual" stopping position, that is, serving of four neighboring floors by only two stops of the same elevator no overlapping of "alien" stopping positions, that is, serving four neighboring floors by only one stop each of two elevators of the same elevator group preference of the front or of the rear individual car 5 or 6.

For the alteration of the criteria chains forming the basis of the car assignment algorithm (DZA). the individual criteria are combined and/or their priorities are altered, for example by parameter control.

The apparatus for the execution of the above-described method includes a group control for elevators with double cars, which double cars are formed of two individual cars arranged in a common cage frame, in each case serving two neighboring floors, with car memories and load measuring devices assigned to the cars, with floor call memories, with selectors assigned to every elevator of the group indicating in each case the floor of a possible elevator stop and scanning devices R1 and R2 having at least one position for each floor, as well as a microcomputer system 7 and a computing device CPU, which at every position of a first scanner R1 of the scanning device determines operating costs (K) corresponding to the waiting times of all passengers involved, wherein two partial cost memories RAM7 and RAM8 are provided each for storing the internal and external partial costs ($K_I$, $K_A$) with two storage locations (v, h) per scanner position $\alpha$ for the partial costs $K_I$; $K_{Ih}$; $K_{Av}$; $K_A$h for each individual car 5 and 6. The control includes a first total cost memory RAM9, in which the standardized total costs $K_{gs}(\alpha)$ determined from the internal operating costs $K_{Iv}(\alpha)$, $K_{Ih}(\alpha\pm1)$ and the external operating costs $K_{Av}(\alpha)$. $K_{Ah}(\alpha\pm1)$ are stored for every scanner position $\alpha$, an individual car/call assignment memory RAM11 in which the single car is designated which, on the basis of the criteria chain, is optimally assigned to the scanner position $\alpha$, a second total cost memory RAM10 in which the modified total costs $K_{gm}(\alpha)$. determined on the basis of the individual car/call assignment by modification of the standardized total costs $K_{gs}(\alpha)$, are stored for every scanner position $\alpha$, a comparison device 14, which is connected by a bus B with the total cost memories RAM10 for the modified total costs $K_{gm}(\alpha)$ and with the double car/call assignment memories RAM12 of all elevators, wherein the comparison of the modified total costs $K_{gm}(\alpha)$ takes place at every scanner position $\alpha$ during one cycle of the second scanner R2, a double car/call assignment memory RAM12 in which, for the elevator a, b or c which exhibits the lowest modified total costs $K_{gm}(\alpha)$ with respect to a scanner position $\alpha$, an assignment command can be entered, a comparator circuit VS which is connected with the operating status memories RAM5 and RAM6 of the individual cars wherein, for the calculation of the first addition KAE, the greater of the door status factors $S_{Tv}$ and $S_{Th}$ of the front and rear individual cars respectively and for the calculation of the second addition KAZ. the greater of the loss times $t_v'+k_{1v}+k_{2v}$ and $t_v'+k_1h+k_{2h}$ of the front and rear individual cars can be selected.

In the calculating process, the internal operating costs and the increase of the external operating costs are determined separately for both individual cars: The total internal costs for a double car position $(\alpha,\alpha+1)$ are determined by addition of the separately calculated internal operating costs of the two individual cars at the floors $\alpha$ and $\alpha+1$. The external operating costs consist, as in the group control for individual cars, of three shares:

- a share $m\cdot t_m$ depending on the floor distance traveling time
- a share KAE depending on the operational status of the two individual cars
- a share KAZ dependent on cell serving at intermediate floors (both cars).

The additions due to operating status and call serving are calculated separately for each individual car.

As the increase of the external operating costs due to call serving by the double car, the greater increase of the two individual cars is taken. In the same manner, the increase is defined as the greatest increase from the two for individual cars. In both cases, therefore, the "worst case" values are taken. The total external operating costs for a double car position result from the fact that the three above mentioned shares are added to the external operating costs of the previous double car position. The total operating costs consist of the internal and external operating costs. The total costs $K_g(\alpha)$ for one elevator position $(\alpha,\alpha+1)$ are stored at the location $(\alpha+1)$ of the total cost memory RAM9, the scanner R1 is switched to the next floor and the calculation repeated accordingly. After termination of the cost calculating cycle KBZ at the time II, the second scanners R2 start a cycle simultaneously on all elevators a, b and c, called a cost comparison cycle KVZ, beginning with the first floor at the time III. The start of the cost comparison cycles KVZ takes place, for example, five to ten times per second. At every scanner position, the modified total operating costs $K_{gm}$. stored in the total cost memories RAM10 of the elevators a, b and c, are transmitted to the comparator device 14 and compared to each other. In each case, an assignment command in the form of a logic "1" can be stored in the assignment memory RAM12 of the elevator with the lowest modified total operating costs Kgm which designates that floor to which the respective elevator is assigned optimally in time. Let, for instance, a new assignment take place, based on the comparison in the scanner position "9", by cancellation of an assignment command for the elevator b and entry of one for the elevator a (FIG. 1). By the new assignment at scanner position "9", a new cost calculating cycle KBZ is started for each of the elevators a and b and the cost comparison cycle KVZ is interrupted since the former has priority. According to the example, a floor call is stored for the floor E9 and the elevator a is designated for serving it. It is noted in the scanner position "9" of the scanner R1 during the cost calculating cycle KBZ and, by means of a car/call assignment algorithm DRZ, in the individual car/call assignment RAM11, as result of the modifications, which car of the elevator a is the more favorable one for serving the floor call.

Subsequently, the cost comparison is continued from the scanner position "10", and is interrupted again at the scanner position "9" (downward) by the occurrence of an event with respect to the elevator c, for instance, the change of the selector position at the time VI. After termination of the cost calculating cycle KBZ triggered by this event with respect to the elevator c at the time VII, there takes place the continuation of the cost comparison cycle KVZ and its termination at scanner position "2" (downward) Between the points of time VIII and IX, there proceeds a further cost calculating cycle KBZ for the elevator a, triggered for example by a car call, whereupon at the point of time X, the next cost comparison cycle KVZ is started. The entire cost comparison cycle can proceed also without interruption independent of the events occurring.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for the group control of elevators with double cars in which, for the determination of an optimally applicable elevator for the serving of a floor call at a floor in a scanner position $\alpha$, the operating costs defined as loss of time of all passengers involved in serving a call is the criterion of decision, and for which these operating costs are calculated and stored separately for each elevator within the framework of a cost calculating cycle KBZ for every scanner position $\alpha$, whether a floor call exists or not, and subsequently are compared for all elevators together within the framework of a cost comparison cycle KVZ, wherein the elevator with the lowest operating costs for the respective scanner position $\alpha$ is assigned by a control apparatus as the favored for serving an eventual floor call and where also the assignment of a certain individual car of the corresponding double car is provided for the scanner position $\alpha$ to be served, characterized by the following steps:

(a) For the characterization of the applicability of a double car with respect to the serving of a floor call in a scanner position $\alpha$, the following are defined for the double car as total operating costs $K_g(\alpha)$:

$$K_g(\alpha)=G\cdot K_{Ig}(\alpha)+K_{Ag}(\alpha)$$

(b) For the serving of a scanner position $\alpha$ by a double car, certain standard call serving positions are established by the position of the individual cars depending on the call serving directions the serving position $\alpha,\alpha+1$ for the downward call serving direction, as well as the serving position $\alpha,\alpha-1$ for the upward call serving direction and the standardized total operating costs $K_{gs}(\alpha)$ defined as follows:

$$K_{gs}(\alpha)=G\cdot[S\cdot[K_{Iv}(\alpha)+K_{Ih}(\alpha\pm1)]]+[K_{Av}(\alpha)+K_{Ah}\cdot(\alpha\pm1)]$$

(c) For every double car, the standardized total operating costs $K_{gs}(\alpha)$ are calculated within the framework of its cost calculating cycle (KBZ) in every scanner position $\alpha$ according to step b by means of a cost calculating algorithm (KBA) and subsequently stored in a first total cost [memory, wherein the internal operating costs $K_{Iv}(\alpha)$ and $K_{Ih}(\alpha\pm1)$ as well as the external operating costs $K_{Av}(\alpha)$ and $K_{Ah}(\alpha\pm1)$ are calculated separately and are also stored separately in corresponding partial cost memories respectively;

(d) For every double car, the individual car optimal for serving is determined within the framework of its cost calculating cycle (KBZ) and marked in an individual car/call assignment memory, wherein immediately after the cost calculating algorithm (KBA), that call serving position $(\alpha,\alpha+1)$ or $(\alpha,\alpha-1)$ is found by means of a car assignment algorithm which is an optimum in the sense of a hierarchically sequenced chain of criteria for the respective scanner position $\alpha$;

(e) The total servicing costs $K_g(\alpha)$, designate modified total servicing costs $K_{gm}(\alpha)$, are determined for every double car within the framework of its cost calculating cycle KBZ in every scanner position $\alpha$ for the optimal serving positions $\alpha$, $\alpha+1$-/$\alpha,\alpha-1$ according to step d and stored in a second total cost memory, wherein the standardized total operating costs $K_{gs}(\alpha)$ are modified immediately after the car assignment algorithm (DZA) by means of a cost modification algorithm (KMA), depending on whether the car assignment according to step d agrees with the standardized call serving position or not; and (f) The modified total operating costs $K_{gm}(\alpha)$ of all elevators are compared, within the framework of the cost comparison cycle (KVZ) including all elevators of the elevator group, in a comparator circuit for every scanner position $\alpha$, and the double car with the lowest modified total operating costs $K_{gm}(\alpha)$ marked as "favored" for the serving of an eventual floor call at the scanner position and, if necessary, the car is immediately assigned.

2. The method according to claim 1 wherein the cost calculating algorithm (KBA) for the calculation of the standardized total operating costs $K_{gs}(\alpha)$ is based on the following calculating formula:

$$K_{gs}(\alpha)=G\cdot S\cdot t_v\cdot[[P_{Mv}+K_{1v}\cdot R_{Ev}-k_{2v}\cdot R_{Cv}]+[P_{Mh}+k_{1h}\cdot R_{Eh}-k_{2h}\cdot R_{CH}]]+[m\cdot t_m+KAE+KAZ]\cdot k_{1g}.$$

3. The method according to claim 2 wherein the total lost time, determining the total external costs ($K_{Ag}$), is equal to the lost time (m·tm) for travelling the floor distances between the selector and scanner positions, increased by a first addition (KAE) for the lost time at the levelling in at the scanner position $\alpha$ and a second addition (KAZ) for the lost time from one or more intermediate stops.

4. The method according to claim 3 wherein the first addition (KAE) is determined from the operating conditions of the double car from which the leveling in at the scanner position $\alpha$ has to be accomplished, where for the operating conditions "acceleration", "full-speed travel" and "brake action". KAE is calculated from the respective drive status factor (SA) according to the formula $$KAE=S_A\cdot t_v'$$

and, for the operating status "stop", from the greater of the door status factors $S_{Tv}$;$T_h$ for the front and the rear individual cars respectively according to the formula $$KAE=max[S_{Tv}/S_{Th}]\cdot t_v'$$

5. The method according to claim 3 wherein the second addition (KAZ) is recursively calculated from the lost time ($KAZ_{init}$) at an eventual intermediate stop at the selector position and from the time losses ($\Delta$KAZ) at eventual intermediate stops between the selector and scanner positions according to the formula $$KAZ=KAZ_{init+\Sigma\Delta KAZ}$$

where $KAZ_{init}$ is determined according to claim 4 from the drive and door status factors of the double $\Delta$KAZ, the greater of the time losses $t_v'+k_{1v}+k_{2v}$ and $t_v'+k_{1h}+k_{2h}$ calculated for the front and rear individual cars respectively is taken.

6. The method according to claim 1 wherein the criteria chains forming the basis of the car assignment algorithm (DZA) are hierarchically sequenced, wherein the criteria of highest priority are compiled in a group "compulsory assignment" and the criteria of low priority in a group "free assignment".

7. The method according to claim 6 wherein for the group "compulsory assignment", the corresponding car assignments are required and the following criteria are used in descending priority:

coincidence "car call-floor call"

non-serving of a scanner position $\alpha$ with the individual car (5,6) at full load non-serving of a scanner position $\alpha$ with the individual car in the non-serving operating mode.

8. The method according to claim 6 wherein in the absence of a "compulsory assignment", the following criteria of a "free assignment" are applied:

simultaneous serving of two neighboring cars with or without adjustable imbalance no overlapping of "individual" stopping position, that is, serving of four neighboring floors by only two stops of the same elevator no overlapping of "alien" stopping positions, that is, serving four neighboring floors by only one stop each of two elevators of the same elevator group preference of the front or of the rear individual car.

9. The method according to claim 6 wherein for the alteration of the criteria chains forming the basis of the car assignment algorithm (DZA), the individual criteria are combined and/or their priorities are altered by parameter control.

10. An apparatus for the group control of elevators with double cars, which double cars are formed of two individual cars arranged in a common cage frame, in each case serving two neighboring floors, having car memories and load measuring devices assigned to the cars, floor call memories, selectors assigned to every elevator of the group indicating in each case the floor of a possible elevator stop and scanning devices having at least one position for each floor, as well as a microcomputer system and a computing device, which at every position of a first scanner of the scanning device determines operating costs (K) corresponding to the waiting times of all passengers involved, wherein two partial cost memories are provided each for storing the internal and external partial costs ($K_I$, $K_A$) with two storage locations (v, h) per scanner position $\alpha$ for the partial costs $K_I$, $KI_h$, $K_{Av}$, and $K_A$h for each individual car comprising:

a first total cost memory in which the standardized total costs $K_{gs}(\alpha)$ determined from the internal operating costs $K_{Iv}(\alpha)$, $K_{Ih}(\alpha\pm1)$ and the external operating costs $K_{Av}(\alpha)$, $K_{Ah}(\alpha\pm1)$ are stored for every scanner position $\alpha$;

an individual car/call assignment memory in which the individual car is designated which, on the basis of a criteria chain, is optimally assigned to the scanner position $\alpha$;

a second total cost memory in which the modified total costs $K_{gm}(\alpha)$, determined on the basis of the individual car/call assignment by modification of the standardized total costs $K_{gs}(\alpha)$. are stored for every scanner position $\alpha$;

a comparison device, which is connected by a bus with the total cost memories for the modified total costs $K_{gm}(\alpha)$ and with the double car/call assignment memories of all elevators, wherein the comparison of the modified total costs $K_{gm}(\alpha)$ takes place at every scanner position $\alpha$ during one cycle of the second scanner;

a double car/call assignment memory in which, for the elevator which exhibits the lowest modified total costs $K_{gm}(\alpha)$ with respect to a scanner position $\alpha$, an assignment command can be entered; and a comparator circuit which is connected with the operating status memories of the individual cars wherein, for the calculation of the first addition KAE, the greater of the door status factors $S_{Tv}$ and $S_{Th}$ of the front and rear individual cars respectively and for the calculation of the second addition KAZ, the greater of the loss times $t_v'+k_{1v}+k_{2v}$ and $t_v'+k_{1h}+k_{2h}$ of the front and rear individual cars can be selected.

11. In an apparatus for controlling a group of double elevator cars, each double car including two individual cars in a common frame guided in a shaft for serving two neighboring floors and driven by a hoist through a hoisting cable, having a measurement and regulating unit connected to the hoist and connected through a first interface to a microcomputer system, having a load weighing device and a device for signalling the actual operating status of the car connected to the microcomputer system through the first interface, having scanning devices for each individual car with at least one position for each floor, having selectors for each double car indicating the floor of a possible stop, each car having car call buttons and each floor having floor call buttons connected to the microcomputer system through an input device and a second interface, a comparator circuit connected to the microcomputer systems of all the elevators in the group through third interfaces, and a partyline transmission system connected to the microcomputer systems of all the elevators in the group through a fourth interface, the improvement comprising:

a computing device in the microprocessor system for determining operating costs corresponding to waiting times of all passengers at every position of a first one of the scanning devices including internal and external partial operating costs for each individual car of a double car;

two partial cost memories connected to said computing device for storing said partial costs for each position of said first scanning device;

a first total cost memory connected to said computing device for storing standardized total costs determined by said computing device from said partial costs for each position of said first scanning device;

an individual car/call assignment memory connected to said computing device for storing a designation of an individual car optimally assigned to each position of said first scanning device by said computing device;

a second total cost memory connected to said computing device for storing modified total operating costs determined by said computing device for each position of said first scanning device, said comparison circuit comparing said modified total operating costs for all elevators of the group at every position of a second one of said scanning devices;

a double car/call assignment memory connected to said computing device for storing an assignment command for the elevator which exhibits the lowest modified total operating costs with respect to each position of said second scanning device; and a comparator circuit connected to said computing device, to said partial cost memories, to said first and second total cost memories and to said individual car/call assignment memory for determining the median lost time associated with external costs resulting from intermediate stops between the car position and the position of said second scanning device, said computing device adding said median lost time to lost time for travelling floor distances and lost time for levelling in at a stop to obtain a total lost time determining total external costs for each elevator.

12. The apparatus according to claim 11 including an adder having one input connected to an output of said comparator circuit, another input connected to an output of a source of said median lost time and an output selectively connected to an input of said source of said median lost time for generating said median lost time in a recursive calculation from a lost time for a stop at a selector position and time losses for intermediate stops between the selector position and said second scanner positions.

* * * * *